US005108114A

United States Patent [19]

Marx

[11] Patent Number: 5,108,114

[45] Date of Patent: Apr. 28, 1992

[54] COLLAPSIBLE SPORTS RACKET

[76] Inventor: Alvin J. Marx, 107 Georgian Court Rd., Rochester, N.Y. 14610

[21] Appl. No.: 698,375

[22] Filed: May 9, 1991

Related U.S. Application Data

[63] Continuation of Ser. No. 461,698, Jan. 8, 1990, abandoned.

[51] Int. Cl.[5] ..... A63B 49/00; A63B 49/02

[52] U.S. Cl. ..... 273/73 G; 273/73 R; 273/73 C; 273/73 H

[58] Field of Search ..... 273/73 R, 73 C, 73 E, 273/73 G, 73 H, 73 J, 73 L, 75

[56] References Cited

U.S. PATENT DOCUMENTS

| | | | |
|---|---|---|---|
| 1,673,614 | 6/1988 | Boening . | |
| 1,808,035 | 6/1931 | Guenard | 273/73 C |
| 1,832,298 | 11/1931 | Greenspan | 273/73 J |
| 1,967,355 | 7/1934 | Edwards | 273/67 R |
| 3,833,218 | 9/1974 | Frenkel et al. | 273/73 J |
| 4,007,929 | 2/1977 | Figa | 273/73 G |
| 4,052,060 | 10/1977 | Balkcom | 273/73 G |
| 4,077,627 | 3/1978 | Cheatham et al. | 273/73 R |
| 4,101,125 | 7/1978 | Heath | 273/75 |
| 4,746,119 | 5/1988 | Jeanrot | 273/73 J |

FOREIGN PATENT DOCUMENTS

| | | | |
|---|---|---|---|
| 2617405 | 1/1989 | France | 273/73 R |
| 2620627 | 3/1989 | France | 273/73 R |
| 1088733 | 4/1984 | U.S.S.R. | 273/73 P |
| 1199253 | 12/1985 | U.S.S.R. | 273/73 J |
| 3204 | 7/1881 | United Kingdom | 273/73 R |
| 12753 | of 1886 | United Kingdom | 273/73 C |
| 802 | of 1908 | United Kingdom | 273/73 R |
| 710625 | 4/1953 | United Kingdom | 273/73 J |

*Primary Examiner*—Edward M. Coven
*Assistant Examiner*—Raleigh W. Chiu
*Attorney, Agent, or Firm*—Hopgood, Calimafde, Kalil, Blaustein & Judlowe

[57] ABSTRACT

A collapsible sports racket comprising, in accordance with one aspect of the present invention, a shaft having a mounting member extending from one end and a grip handle extending from the other end; a head having a neck with a receptacle for receiving the mounting member; a threaded member slidably disposed along the mounting member for rotational engagement with a threaded collar on the neck so as to releasably secure the head to the shaft; radially disposed projections mounted to the member for restricting rotation of the shaft with respect to the neck along its longitudinal axis upon engagement with the receptacle; and guideways in the receptacle for receiving the projections upon engagement of the mounting member with the receptacle so as to limit longitudinal rotation. In the alternative, the coupling assembly of the present invention comprises a link member pivotally mounted to the mounting member such that the shaft may pivot about the racket head, and a guideaway in the neck adapted for receiving the link member; the link member having pins at one end adapted for pivotal engagement with grooves in the guideway to facilitate the pivotal movement of the shaft about the head.

20 Claims, 4 Drawing Sheets

COLLAPSIBLE SPORTS RACKET

This application is a continuation of application Ser. No. 07/461,698, filed Jan. 1, 1990, abandoned.

DISCLOSURE OF THE INVENTION

The invention relates to sports equipment and, more specifically, to an improved collapsible sports racket and method for collapsing the same.

The portability of racket equipment has contributed to the popularity of racket sports such as tennis, racquetball, squash and the like among exercise enthusiasts. Carrying cases as well as collapsible rackets have been developed to improve the portability of these rackets.

Conventional collapsible rackets have taken a number of forms. For example, a two piece, detachable racket assembly has been used which comprises a head piece removably mounted to a shaft having a 4-sided handle. Fasteners such as screws, bolts or lock pins secure the head piece to the shaft. Upon disengaging the fasteners, the racket may be separated into two pieces for storage in a carrying case. Other collapsible rackets utilize a one piece fold-up type assembly having a racket head joined to a shaft using a hinge mechanism which permits the head to pivot with respect to the shaft so that the racket may be folded in half.

A few prior collapsible rackets are shown, for example, in U.S. Pat. No. 1,673,614 issued to Boening, U.S. Pat. No. 4,007,929 issued to Figa and U.S. Pat. No. 4,746,119 issued to Jeanrot, and British Patent Nos. 3201 issued to Simons and 710,625 issued to Cowburn.

However, because some of these rackets do not readily fit inside an attachè case upon collapse, a separate carrying case may be necessary which is bulky and requires a free hand to carry. After being secured in an operative position for play, some of these rackets have a tendency to twist about the longitudinal axis during use. If one side of the handle is not secured in alignment with a playing surface on the head, the user will be unable to control the trajectory of an object (such as a ball) struck by the racket during play. Also, conventional fasteners used to secure the head to the shaft loosen easily during play requiring repeated tightening by the user which often requires tools. Should the head separate from the shaft, the head may be hurled through the air only to strike another player or a spectator. Aside from safety considerations and difficulty of assembly and disassembly, the complexity of these rackets adds needlessly to the cost of manufacture. Finally, the small parts used in some of these rackets are easily lost.

Thus it is an object of the present invention to provide a reliable, durable, safe and economical sports racket which is easy to assemble, disassemble and/or fold-up for transportation or storage in an attache case or the like.

The above and other objects of the present invention are realized in a specific, illustrative collapsible racket apparatus which comprises a shaft having a mounting member extending from one end and a grip handle extending from the other end; a head having a neck with a receptacle adapted to receive the mounting member; a threaded member slidably disposed along the mounting member for rotational engagement with a threaded collar on the neck so as to releasably secure the head to the shaft; radially disposed projections mounted to the member for restricting rotation of the shaft with respect to the neck along its longitudinal axis upon engagement with the receptacle; and guideways in the receptacle for receiving the projections upon engagement of the mounting member with the receptacle so as to limit longitudinal rotation.

Another specific, illustrative collapsible racket apparatus comprises a coupling assembly having a link member pivotally mounted to the mounting member such that the shaft may pivot about the head, and a guideway in the neck adapted for receiving the link member; the link member having pins at one end adapted for latching engagement with grooves in the guideway to facilitate the pivotal movement of the shaft about the head.

The above and other features and advantages of the present invention are realized in specific, illustrative embodiments thereof, presented hereinbelow in conjunction with the accompanying drawing, in which.

Figure 1:
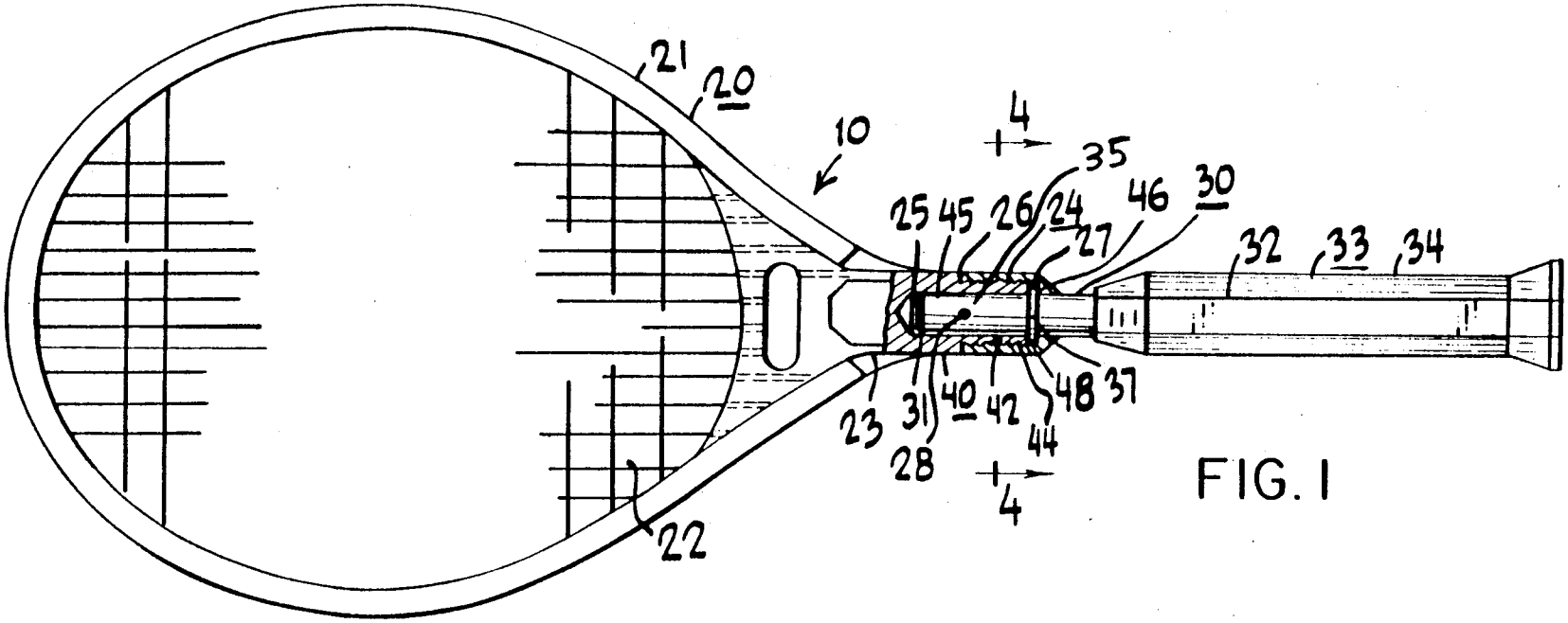
FIG. 1 is a plan view of a collapsible sports racket assembly in accordance with the present invention.

Referring now to the drawings and more particularly to FIG. 1, there is shown generally a collapsible sports racket assembly 10 having a head portion 20 detachably mounted to a shaft portion 30 at a coupling assembly 40.

Figure 2:
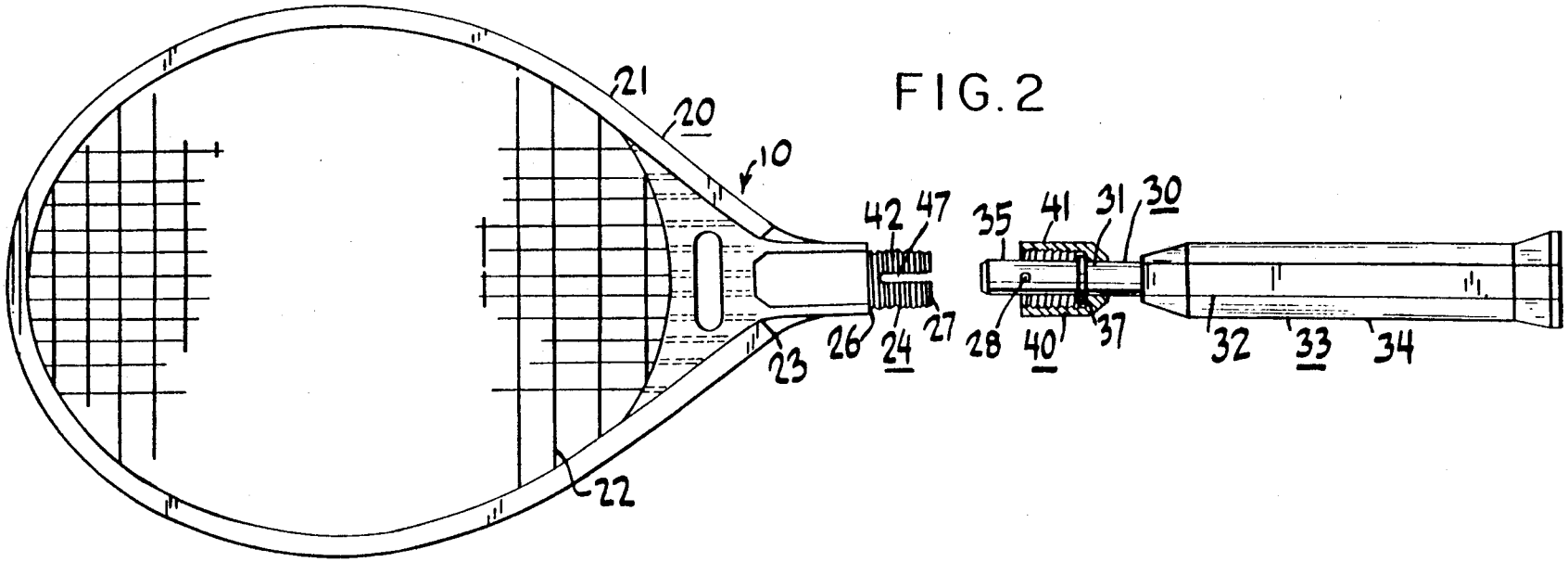
FIG. 2 shows the assembly of FIG. 1 in a detached position.

As shown in FIG. 2, the shaft 30 has an upper end 31 and a lower end 32. Lower end 32 mounts an elongated handle 33 having a gripping surface 34 comprising rubber, leather or the like. The handle extends from the shaft to allow a user to grasp the racket firmly for play. Upper end 31 mounts a cylindrical extension or mounting member 35 having a diameter preferably less than that of the shaft, thereby forming a seat or flange 37 at the base of the extension adapted for contact with head portion 20.

Figure 5:
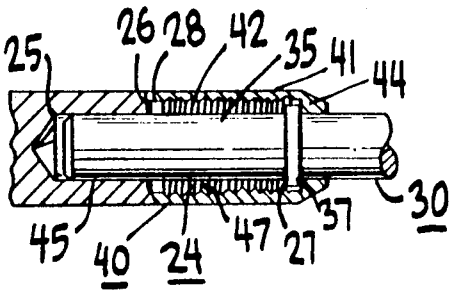
FIG. 5 is an enlarged view of the cut away assembly of FIG. 1.

Head 20 comprises an oval frame 21 which supports a playing surface 22, for example, tightly woven nylon netting. A neck portion 23 tapering from the lower end of head 20 mounts a cylindrical receptacle 24 having a cylindrical internal cavity 45, as best seen in FIG. 5. The diameter of the cavity is of a size suitable for sliding engagement with cylindrical extension 35. Upon inserting the extension into the receptacle cavity, the extension is slidably moved into the cavity toward upper or closed end 25 until flange 37 contacts neck lower end 26. In this position, the extension substantially fills the cavity; the head and shaft being joined together to define an operative position of the racket assembly. Complete filling of the receptacle cavity by the extension adds strength to the joint between the head and shaft.

Figure 4:
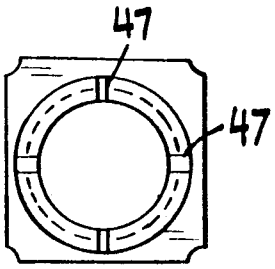
FIG. 4 is a sectional view of FIG. 1 taken along line 4—4.

The cylindrical extension mounts a pair of radially extending projections or pins 28 offset 180 degrees from one another. As shown in FIGS. 2 and 4, a plurality of guideways or vertical slots 47, adapted for receiving the pins, are disposed lengthwise at intervals about the circumference of the receptacle. At least two of these slots have selected widths and orientations suitable for engaging the pins upon sliding the extension into lower or open end 27 of the receptacle cavity. Upon engagement of the pins with the vertical slots, rotation of the shaft along its longitudinal axis with respect to the head is restricted. This feature maintains the handle in proper alignment with the racket head so that the user may readily control the trajectory of an object (such as a ball) struck by the racket.

Figure 3:
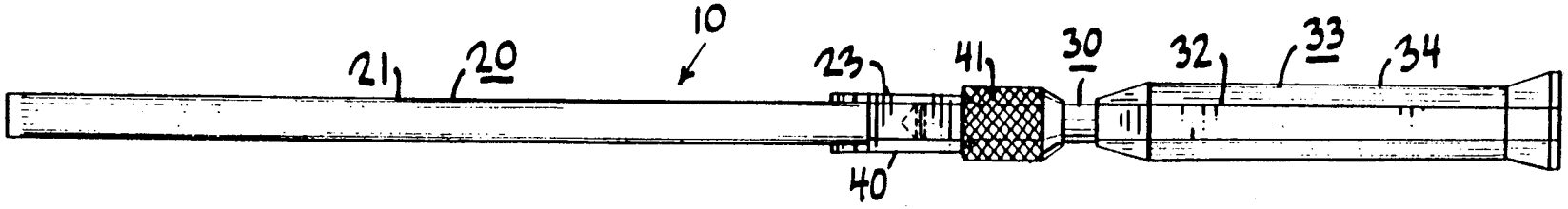
FIG. 3 is a side view of the assembly of FIG. 1.

Coupling assembly 40 includes a threaded locking member or nut 41 mounted to the extension for sliding engagement between the flange and the pins, as best seen in FIG. 2. The receptacle has a collar 42 on its lower exterior surface which is also threaded for rotational cooperation with the locking nut As shown in FIGS. 1 and 3, upon screwing the locking nut onto the collar, internal end 44 of the locking nut engages the flange so as to hold the shaft securely to the head. The locking nut is provided with a knurled surface suitable for grasping by a users hand to affect maximum tightening without slippage due to hand moisture. This novel coupling assembly provides a reliable means for securing the head to the shaft thereby preventing injury to players and spectators. The assembly is also advantageous in maintaining the high degree of structural rigidity necessary for use of the racket in sporting activities.

As shown in FIG. 1, a washer 46 may be mounted to the extension to rest against flange 37. Once the extension has been inserted into the receptacle and the end of the extension abuts receptacle upper end 25, the washer is sandwiched between lower edge 48 of the collar and flange 37; a crucial point of contact between the flange and the collar. In this manner, the washer minimizes handle vibration induced by striking a ball or the like on the racket playing surface.

To secure the head to the shaft, the extension is first inserted into the receptacle, the shaft being rotated so as to align the pins on the extension with the corresponding guideway slots. Next, the extension is moved into the receptacle, the pins slidably engaging the slots upon upward linear displacement of the extension. Once the receptacle lower end contacts the flange and the upper end of the extension engages receptacle upper end 25, the locking nut is biased upward against threaded collar 42 and is simultaneously screwed in a clockwise direction. After the locking nut has been screwed completely onto the receptacle exterior to a selected tightness, the shaft is secured to the head; the racket assembly being in the operative position.

To collapse the racket assembly, the locking nut is grasped by a user and unscrewed until the threaded portion of the nut is completely out of engagement with the threaded collar. The gripping surface of the shaft is then grasped firmly and the shaft is pulled downward, causing the pins to slide through and out of engagement with the slots.

Figure 6:
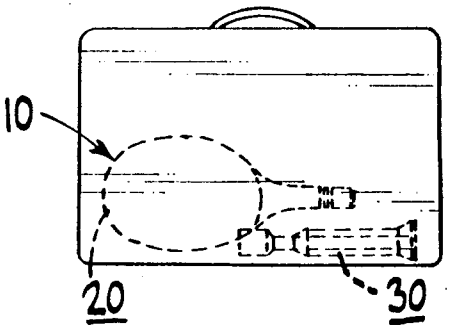
FIG. 6 shows the racket assembly of FIG. 2 collapsed in an attache case.

Once the shaft has been completely disengaged from the head, the racket assembly is in a collapsed or stowed position suitable for storage or transportation in an attachè case, as shown in FIG. 6. Separation of the head from the shaft also allows the user to change racket heads and select a desired net stiffness, whether for warming-up or a tennis match.

Although the present invention has been described as having two pins, it is understood that any number of pins may be used provided rotation of the shaft along its longitudinal axis is inhibited. For example, four pins may be used to restrict rotational movement provided the receptacle has guideways of suitable widths to receive each pin.

Figure 7:
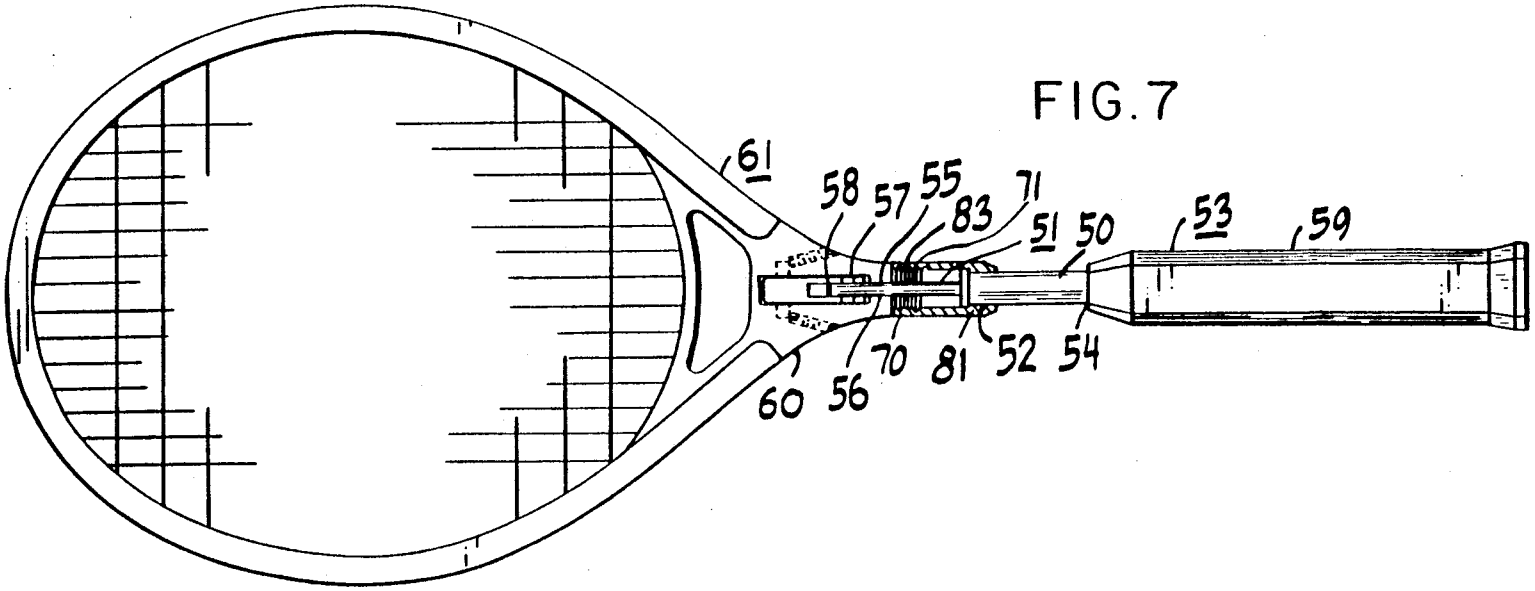
FIG. 7 is a plan view of an alternative embodiment of the present invention.
Figure 12:
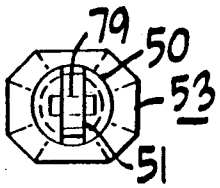
FIG. 12 is an end view of the shaft of FIG. 11.

Alternatively, the coupling assembly may take the form of a detachable folding mechanism. As shown in FIG. 7, shaft 50 mounts a mounting member or pivot bar 51 at one end 52 and a handle portion 53 which extends from the opposite end 54. The pivot bar has upper and lower parallel surfaces 55 and 56, respectively, as best seen in FIGS. 10 and 12. A pin 57 is inserted in a hole 85 at pivot bar end 58 so as to extend from and generally perpendicular to the upper and lower surfaces, respectively. As shown in FIGS. 7–9 and 11, the handle portion has a gripping surface 59 comprising rubber, leather or the like which permits a user to grasp the racket firmly for play.

As best seen in FIG. 10, a neck portion 60 which tapers from lower end 61 of the head mounts a coupling assembly 70 pivotally connected to the neck. The coupling assembly includes a link member 74 having radially extending pins 76 disposed 180 degrees from one another at one end 75. A slot 77 is formed proximate to the other end 78 for slidably receiving and coupling the pivot bar 51 to the link member; the slot having a width suitable for sliding engagement with the pivot bar. Apertures 79 disposed across from one another on each side of slot 77 are adapted to receive pin 57 for pivotal movement of the shaft about the link.

Figure 9:
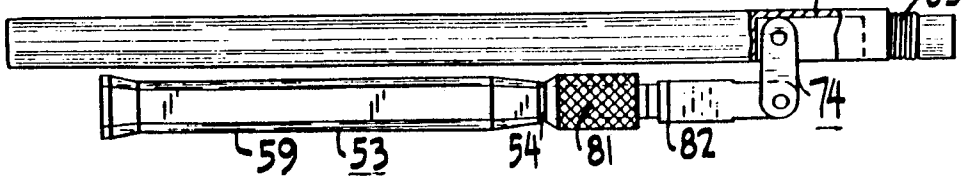
FIG. 9 shows the assembly of FIG. 7 in a folded-up or stowed position.
Figure 10:
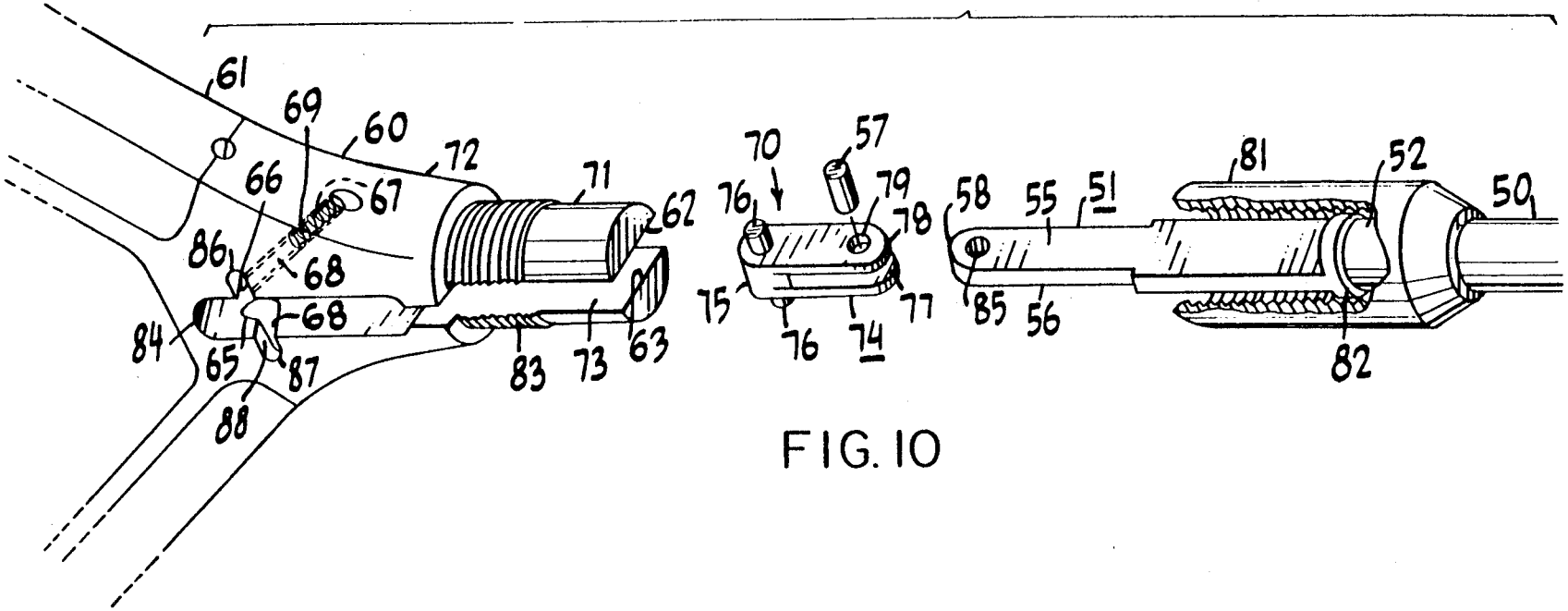
FIG. 10 is a exploded perspective view of the coupling assembly of FIG. 7.
Figure 11:
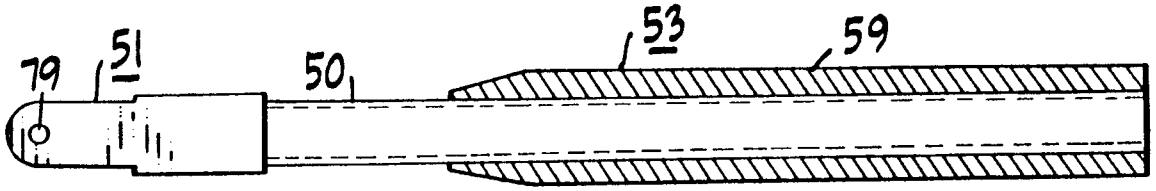
FIG. 11 is a side view of the shaft of the present invention.

In FIG. 10, the coupling assembly also mounts an adapter 71 at neck lower end 72 having parallel walls 62, 63 which define a guideway or vertical slot 73 disposed along the length thereof; the upper portion of the guideway being bounded on one side by wall 64, as shown in FIG. 9. Guideway slot 73 is adapted for sliding engagement with link member 74.

Upper end 84 of the guideway slot has a pair of aligned grooves 86, 87 disposed 180 degrees from one another, one groove in each of the guideway walls. Each groove has a cylindrical recessed portion 65 along its upper wall; the recessed portion having a configuration suitable for receiving one of the link pins 76 therein. The lower wall of each groove has an opening 66 in communication with a passageway 67 leading into the adapter housing 71. Each passageway houses a lock pin 68 biased outwardly from the opening by a spring 69 at the bottom of the passageway. Upon engagement with the grooves, link pins 76 force lock pins 68 downward and into their respective passageways. Once the link pins have cleared recessed portion edges 88, the lock pins then force the link pins into the recessed portions so as to lock them in place.

In this manner, the link is releasably mounted to the adapter such that the shaft may pivot about the head between a stowed or folded-up position and an operative position.

Figure 8:
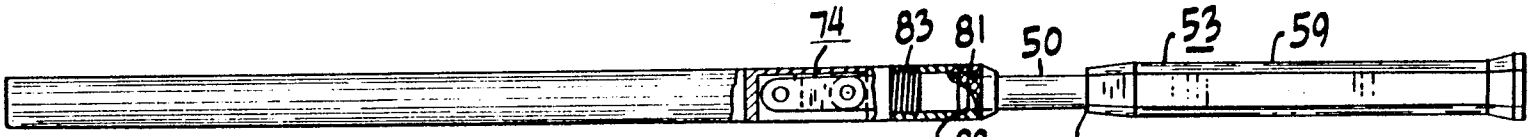
FIG. 8 is a side view of the assembly of FIG. 7.

A threaded lock nut 81 is mounted along the shaft for sliding movement between flange 82 and the handle portion. Upon locking engagement of the link pins with the recessed portions, the lock nut may be screwed onto a threaded collar 83 adjacent to the adapter lower end. Once the lock nut has been screwed completely onto the adapter, the racket assembly is secured in the operative position, as shown in FIGS. 7 and 8.

To fold the racket into the stowed position, the lock nut is unscrewed until the threaded portion of the lock nut is completely disengaged from the threaded collar. The shaft may then be pulled upward and away from the plane of the racket head, the shaft simultaneously pivoting about pin 57 and the link about pins 76. Thereby, the link is shifted to a position generally perpendicular to the plane of the racket head. The shaft is then folded over and onto the face of the racket, as shown in FIG. 9, for storage or transportation. This orientation is advantageous over conventional fold-up rackets in limiting the length of the folded racket assembly to the size of the racket head for ready placement in an attachè case.

To place the racket in the operative position, the shaft is pivoted about the pivot bar pin and away from the face of the racket. Simultaneously, the link pivots about the link pin so as to position the shaft in alignment and coincident with the head; the head and shaft being in a like plane. The lock nut is then screwed onto the threaded collar to a selected tightness so as to releasably secure the shaft to the head.

To separate the racket head from the shaft, first the lock nu is unscrewed until the threaded portion of the lock nut is completely disengaged from the threaded collar. Next, the handle portion is grasped and pulled downward, the link pins forcing the lock pins back into their respective passageways against the bias of the springs. Once the link pins have cleared the recessed portion edges, the shaft is pulled outward and away from the racket head so that the link pins slide out of engagement with the grooves. The shaft is then completely detached from the racket head.

The apparatus of the present invention may be constructed of a variety of different materials. However, when selecting the materials to be used one should keep in mind the stresses to which the apparatus will be subjected during play and storage. For example, although the racket assembly has been depicted as being made of fiberglass, any material or combination of materials can be utilized given consideration to uses for which the present invention is intended.

The above-described arrangement and methodology is merely illustrative of the principles of the present invention. Numerous modifications and adaptions thereof will be readily apparent to those skilled in the art without departing from the spirit and scope of the present invention. Thus, for example, the pins for restricting longitudinal rotation could also be located on the interior of the locking nut assembly. Moreover, the pins could be omitted altogether and a threaded mounting member on the shaft could be adapted to screw directly into a threaded receptacle in the neck.

What is claimed is:

1. A collapsible racket assembly which comprises:

a head having a neck;

a shaft having a mounting member extending from one end;

the neck having a receptacle adapted to receive the mounting member so as to releasably join the head to the shaft;

means for restricting rotation of the member about its longitudinal axis upon engagement of the member with the receptacle;

means for pivoting the head with respect to the shaft between a stowed and an operative position;

means for releasably securing the head to the shaft in the operative position upon pivoting the head and shaft onto a like plane;

the restricting means having a projection mounted to the member which cooperates with the receptacle so as to limit rotation of the member about is longitudinal axis;

the restricting means further comprising a guideway in the receptacle which, upon sliding engagement with the projection, limits rotation of the mounting member about its longitudinal axis;

the securing means having a locking member slidably disposed along the mounting member and adapted for rotatable cooperation with the receptacle upon joining the head to shaft;

the pivoting means including a link member pivotally mounted to the mounting member such that the shaft may pivot about the racket head; and the guideway including grooves and the link member having a pin adapted for engagement with the grooves for pivotal movement of the shaft about the head.

2. A method for mounting a collapsible racket shaft to a racket head, which comprises the steps of:

(a) inserting a cylindrical extension of the shaft into a receptacle in a neck portion of the racket head;

(b) rotating the shaft along its longitudinal axis so as to align a pin radially disposed on the extension with a guideway slot disposed along the receptacle;

(c) sliding the extension into the receptacle, the pin sliding along the guideway slot; and (d) rotating a threaded member onto a threaded collar on the receptacle to a selected tightness so as to secure the shaft to the racket head.

3. A method according to claim 2 wherein step b is performed simultaneously with step a.

4. A method for detaching a collapsible racket shaft from a racket head, which comprises the steps of:

(a) rotating a threaded member rotatably engaged with a threaded collar of a receptacle at one end of the racket head so as to unscrew the member from the collar;

(b) sliding an extension at one end of the shaft out of engagement with the receptacle, a pin radially disposed on the extension sliding along a guideway slot formed in the receptacle; and (c) removing the extension from the receptacle so as to separate the shaft from the head.

5. A method for folding a collapsible racket shaft onto a racket head, which comprises the steps of:

(a) inserting an extension of the shaft into a link assembly configured for cooperation with a receptacle in the neck of the racket head;

(b) aligning an aperture in a guideway disposed along the link assembly with a hole in the extension;

(c) sliding a pin through the aperture in the guideway and through the hole in the extension such that the shaft may pivot freely about the link;

(d) rotating the shaft along its longitudinal axis so as to align a pin radially disposed on the link with a guideway slot disposed along the receptacle;

(e) sliding the link into the receptacle, the pin sliding along the guideway slot;

(f) rotating the link so as to engage the link pin with a groove in the guideway slot such that the link may pivot freely about the racket head; and (g) pivoting the link about the link pin and the extension pivoting about the extension pin so as to fold the shaft onto a face portion of the racket head.

6. A method for unfolding a collapsible racket shaft and head into an operative position, which comprises the steps of:

(a) pivoting the shaft about an extension pin on the shaft;

(b) pivoting a link between the head and shaft about a link pin on the head so as to position the racket shaft onto a like plane with the racket head; and (c) rotating a threaded member disposed along the shaft onto a threaded collar on one end of the head so as to secure the shaft to the racket head.

7. A method for unfolding a collapsible racket shaft and head into an operative position, which comprises the steps of:

(a) pivoting a link between the head and shaft about a link pin on the head;

(b) pivoting the shaft about an extension pin on the shaft so as to position the racket shaft onto a like plane with the racket head; and (c) rotating a threaded member disposed along the shaft onto a threaded collar on one end of the head so as to secure the shaft to the racket head.

8. A collapsible racket assembly which comprises:

a head having a neck;

a shaft having a mounting member extending from one end;

the neck having a receptacle adapted to receive the mounting member so as to releasably join the head with the shaft;

the mounting member having a radial projection for restricting rotation of the mounting member about its longitudinal axis upon engagement of the mounting member with the receptacle; and means for releasably securing the shaft to the head upon receipt of the mounting member by the receptacle.

9. The racket set forth in claim 8 wherein the receptacle includes a guideway which, upon sliding engagement with the projection, limits rotation of the mounting member about its longitudinal axis.

10. The racket set forth in claim 9 wherein the securing means comprises a locking member disposed for sliding movement along the mounting member and adapted for rotatable cooperation with the receptacle upon joining the head to the shaft.

11. The racket as set forth in claim 10 wherein the receptacle includes a collar adapted for rotatable engagement with the locking member, whereupon engagement of the mounting member with the receptacle, the head is releasably secured to the shaft.

12. The racket set forth in claim 8 wherein the shaft mounts a handle at an end opposite the mounting member adapted for grasping by a user's hand.

13. A collapsible racket assembly which comprises:

a head having a neck;

a shaft having a mounting member extending from one end;

the neck having a receptacle adapted to receive the mounting member so as to releasably join the head to the shaft;

the mounting member having a radial projection for restricting rotation of the mounting member about its longitudinal axis upon engagement of the mounting member with the receptacle;

means for pivoting the head with respect to the shaft between a stowed and an operative position; and means for releasably securing the head to the shaft in the operative position upon pivoting the head and shaft onto a like plane.

14. The racket as set forth in claim 13 wherein the receptacle includes a guideway which, upon sliding engagement with the projection, limits rotation of the mounting member about its longitudinal axis.

15. The racket as set forth in claim 14 wherein the securing means comprises a locking member slidably disposed along the mounting member and adapted for rotation cooperation with the receptacle upon joining the head to shaft.

16. The racket set forth in claim 15 wherein the receptacle includes a collar adapted for rotatable engagement with the locking member, whereupon engagement of the mounting member with the receptacle, the head is releasably secured to the shaft.

17. The racket set forth in claim 15 wherein the pivoting means includes a link member pivotally mounted to the mounting member such that the shaft may pivot about the racket head.

18. The racket set forth in claim 17 wherein the guideway includes grooves and the link member includes a pin adapted for engagement with the grooves for pivotal movement of the shaft about the head.

19. The racket set forth in claim 13 wherein the handle portion comprises a gripping surface adapted for grasping by a user's hand.

20. A method for mounting a collapsible racket shaft to a racket head, which comprises the steps of:

(a) rotating the shaft along its longitudinal axis so as to align a pin radially disposed on a shaft extension with a guideway slot disposed along a receptacle in the head;

(b) inserting the extension of the shaft into the receptacle;

(c) sliding the extension into the receptacle, the pin sliding along the guideway slot; and (d) rotating a threaded member onto a threaded collar on the receptacle to a selected tightness so as to secure the shaft to the racket head.

* * * * *